US005465567A

United States Patent [19]

Schmolke et al.

[11] Patent Number: 5,465,567

[45] Date of Patent: Nov. 14, 1995

[54] FIBER OPENING DEVICE FOR SEPARATING INDIVIDUAL FIBERS FROM A FIBER SLIVER

[75] Inventors: Karl-Heinz Schmolke, Calw, Germany; Kenneth Lydall, Huddersfield, England

[73] Assignee: Carclo Engineering Group PLC., England

[21] Appl. No.: 185,957

[22] PCT Filed: Jul. 23, 1992

[86] PCT No.: PCT/GB92/01358

§ 371 Date: Jan. 19, 1994

§ 102(e) Date: Jan. 19, 1994

[87] PCT Pub. No.: WO93/02238

PCT Pub. Date: Feb. 4, 1993

[30] Foreign Application Priority Data

Jul. 25, 1991 [DE] Germany ..... 41 24 714.0
Feb. 27, 1992 [GB] United Kingdom ..... 9204158

[51] Int. Cl.[6] ..... D01H 13/02; D01H 4/00

[52] U.S. Cl. ..... 57/408; 19/112; 19/114; 57/301; 57/304; 429/28; 429/33; 429/35

[58] Field of Search ..... 57/408, 411, 327, 57/413, 304, 301; 19/112, 114; 429/33, 35, 28

[56] References Cited

U.S. PATENT DOCUMENTS

| | | | |
|---|---|---|---|
| 3,136,005 | 6/1964 | Reiter et al. | 19/114 X |
| 3,626,681 | 12/1971 | Naruse | 57/416 |
| 3,681,901 | 8/1972 | Jindra et al. | 57/58.91 |
| 3,834,145 | 9/1974 | Ellingham et al. | 57/411 X |
| 4,869,060 | 9/1989 | Stewart et al. | 19/112 X |
| 4,901,519 | 2/1990 | Wassenhoven et al. | 57/408 X |
| 4,939,897 | 7/1990 | Schmolke | 57/301 |

FOREIGN PATENT DOCUMENTS

| | | | |
|---|---|---|---|
| 4114561 | 11/1992 | Germany | 57/411 |
| 214172 | 1/1985 | United Kingdom . | |

*Primary Examiner*—Daniel P. Stodola
*Assistant Examiner*—William Stryjewski
*Attorney, Agent, or Firm*—W. Thad Adams, III

[57] ABSTRACT

A fiber opening device for use in a discontinuous spinning process. The opening device includes an opening roller rotatably mounted about an axis and having a cylindrical working surface which extends around the axis. Opening elements are provided around the working surface. A space is defined between an axially outermost fiber opening element and an adjacent outer edge of the cylindrical working surface. A pressure reduction opening is provided for reducing pressure in or around that space. The pressure reduction opening is arranged to urge fibers into engagement with the working surface.

14 Claims, 6 Drawing Sheets

FIBER OPENING DEVICE FOR SEPARATING INDIVIDUAL FIBERS FROM A FIBER SLIVER

TECHNICAL FIELD AND BACKGROUND OF THE INVENTION

This invention relates to a fibre opening device for use in a discontinuous spinning process and particularly, although not exclusively, to a fibre opening device for an open end spinning machine.

In an open end spinning machine, the flow of fibrous material from feed sliver to yarn is interrupted in that the fibres are fed to a fibre opening device in the form of a rotatably mounted opening roller having a cylindrical working surface around which fibre opening elements are provided. The fibre opening elements may be integrated with the working surface or attached thereto, for example, in the form of carding wire. The fibre opening device separates the fibres of the sliver, the separated fibres then being transferred to a spinning rotor.

The Applicant has noted that, towards the outer edges of the cylindrical working surface of a fibre opening device, the fibre sliver tends to ride up away from the fibre opening elements and, in some cases, the sliver rides up over parts of the opening device which are disposed adjacent to the outer edges of the working surface. Thus, in use, fibres which are disposed towards the outer edges of the working surface are not separated fully and this may lead to defects in the yarn quality.

It is an object of the present invention to alleviate this problem.

Another factor which affects the quality of fibre produced in open end spinning is the presence of microdust in the spinning rotor. Microdust, which is believed to comprise small particles which are torn from the fibres themselves, may gradually build up between adjacent fibre opening elements on the working surface of the opening device. In this case, the presence of microdust may reduce the effectiveness of the opening elements in separating fibres. Furthermore, microdust may gradually be deposited in the groove of a spinning rotor which may consequently reduce the effectiveness of the spinning rotor and the quality of the yarn formed therein.

Many attempts have been made to reduce the level of microdust. For example, European Patent Application No. 0 348 178 (Stewart) discloses a fibre opening device for use with a discontinuous spinning process, the device comprising a rotatably mounted hollow opening roller having a cylindrical working surface from which fibre opening elements project. Holes, which are interspersed with the fibre opening elements, extend through the working surface of the roller and communicate with a hollow region within the roller. A vacuum suction device and a compressed air jet device, provided in the hollow region, are operated when necessary to remove dust, trash and short fibres which pass through the holes in the working surface and which would otherwise remain adhered to an interior cylindrical surface of the opening roller.

SUMMARY OF THE INVENTION

The vacuum suction device and compressed air jet device described is an intermittently operable device for the removal of dust, trash and short fibres which adds significantly to the complexity and cost of the fibre opening device.

It is an object of a preferred embodiment of the present invention, to provide a less complex means of reducing the level of microdust.

According to one aspect of the present invention, there is provided a fibre opening device for use in a discontinuous spinning process, the opening device comprising a rotatably mounted opening roller having a cylindrical working surface around which fibre opening elements are provided, a space being defined between an axially outermost fibre opening element and an outer edge of the cylindrical working surface, wherein a pressure reduction means is provided for reducing pressure in or around that space such that fibres may be urged into engagement with the working surface of the opening roller.

With such a device, the free head-ends of the fibres may be urged into engagement with the working surface of the opening roller, just before the tail-ends of the fibres are released from a clamping point between a feed roller and a feed table arrangement, since once the fibres have been released it may not be possible to guide and direct fibres in a controlled manner.

The provision of such a fibre opening device may reduce the number of fibres which are not engaged with the fibre opening elements of the working surface and, accordingly, may increase the parallelization and separation of fibres by the opening device and reduce defects in the yarn quality.

The fibres are preferably urged in a substantially radial direction into engagement with the working surface of the opening roller.

Preferably, said pressure reduction means includes a passageway, a first end of which opens in or adjacent to said space. A second end of the passageway may open in an area which, with the fibre opening device in use, is at a lower pressure than the pressure in or around the space so that pressure in or above the space may be reduced by the flow of air along said passageway from said first end to said second end.

Preferably, said passageway remains open for all rotational positions of ;he opening roller. Thus, suitably, air flows along said passageway in use for all rotational positions of the opening roller. Preferably, the cross-sectional area of the passageway is fixed and unadjustable in the assembled fibre opening device.

In a preferred embodiment, an opening (for example, a hole or slot) may be provided through the cylindrical working surface in said space for providing said pressure reduction means. Said opening preferably leads into said passageway via said first end thereof.

A second end of the passageway preferably opens through a side of the opening roller. A chamber is preferably provided in said passageway. Said chamber is preferably symmetrically disposed about the rotational axis of the opening roller. Said chamber is preferably annular, the chamber being co-axial with the rotational axis of the opening roller. Said chamber preferably opens through a side wall of the opening roller thereby defining the second end of said passageway. Preferably, an annular opening which leads into the annular chamber is defined in said side wall of the opening roller, said annular opening being co-axial with a hub or a bearing housing of the opening roller. Preferably, an inner cylindrical wall of said annular opening in said side wall is defined by a part of the hub or bearing housing. The radial width of said annular opening may be greater than 0.1 mm. Preferably, the radial width of said annular opening is greater than 0.5 mm. More preferably, the radial width is greater than 2 mm. The radial width may be greater than 3 mm. The provision of a chamber as described may, firstly, increase the efficiency of pressure reduction by said pressure reduction means and, secondly, increase the quantity of microdust which may be removed from fibres being separated by the opening device.

In another embodiment, an opening (for example, a hole or slot) may be provided adjacent to the opening roller, suitably in a part which faces an end of the opening roller, said opening suitably leading into a said passageway in order to provide said pressure reduction means. Preferably, said opening is radially inward of the periphery of said opening element and is axially spaced therefrom. Said passageway preferably extends parallel to the axis of rotation of the opening roller, although it may extend obliquely relative thereto.

Preferably, a plurality of said aforementioned openings and associated passageways is provided, said openings being circumferentially spaced around the working surface of the opening roller at or adjacent to the outer periphery thereof.

Preferably, a pressure reduction means as described in any statement herein is provided adjacent to each outer edge of the cylindrical working surface. In a preferred embodiment, wherein at least one opening is provided through the cylindrical working surface in a space between an outermost fibre opening element and one outer edge of the cylindrical working surface, and wherein at least one opening is provided through the cylindrical working surface in a space between an outermost fibre opening element and the other outer edge of the cylindrical working surface, passageways communicating with said openings preferably lead into a single chamber which may be as described in any statement herein. To achieve this, preferably, a passageway which communicates with each of said aforementioned openings is provided which extends substantially parallel to the axis of rotation of the opening roller.

Preferably, said aforementioned cylindrical working surface of the opening roller is comprised by a ring which is releasably securable to a body of the opening device. The outer cylindrical surface of said ring may include any of the features of the working surface of the opening roller described in any statement herein. Where the opening device includes a passageway which extends substantially parallel to the axis of rotation of the opening roller, said ring preferably defines, at least in part, the outer cylindrical boundary of said passageway.

The invention extends to a ring for a fibre opening device as described in any statement herein, the ring having a cylindrical working surface which includes means for attachment of fibre opening elements or which includes fibre opening elements, a space being defined between said means for attachment or said fibre opening elements and an outer periphery of the ring, wherein an opening is provided in said space which opening extends through said ring.

The opening may be pounded on all sides and, therefore, may be in the form of a hole which extends through the ring. Alternatively, the opening may extend from the outer periphery of the ring and, therefore, may be in the form of a sloe in the ring which extends inwardly from said outer periphery.

The opening may extend in an axial direction through the ring and, in this case, may be provided in a flange part of the ring which flange part may extend substantially perpendicularly to the working surface of the ring. Preferably, said space is defined between said means for attachment or said fibre opening elements and an outer periphery of the cylindrical working surface, said opening being disposed in said space and extending through said working surface, preferably substantially radially.

The ring may include any of the features of the working surface described in any statement herein and may be arranged to be releasably secured to a fibre opening device as described in any statement herein.

The invention extends to the use of a fibre opening device as described in any statement herein for urging fibres into engagement with the working surface of an opening roller of the fibre opening device.

According to a second aspect of the invention, there is provided a fibre opening device for use in a discontinuous spinning process, the opening device comprising a rotatably mounted opening roller having a cylindrical working surface around which fibre opening elements are provided, wherein an opening (for example, a hole or slot) is provided through said cylindrical working surface, the opening communicating with a passageway which extends within the opening roller and out thereof via an opening in a side part of the opening roller, the device being arranged such that, in use, with the opening roller rotating, a continuous air stream flows through said opening in said cylindrical working surface, through said passageway and out of said opening in said side part.

In the invention according to the second aspect, microdust may be carried by said air stream and, therefore, removed continuously in a simple manner. This may obviate the need for intermittent use of a vacuum suction device and a compressed air jet device as described above with reference to European Patent Application No. 0 348 178.

The fibre opening device of the second aspect may include any of the features of the fibre opening device of the first aspect. For example, in a preferred embodiment of the device according to the second aspect, a chamber as described above is preferably provided in said passageway, the chamber suitably being ring-shaped and co-axial with the rotational axis of the opening roller. The chamber preferably opens through the said side part of the opening roller.

The invention further extends to the use of a fibre opening device, which comprises a rotatably mounted opening roller having a cylindrical working surface around which fibre opening elements are provided, an opening being provided through said cylindrical working surface, which opening communicates with a passageway which extends within the opening roller and out thereof via an opening in a side part of the opening roller, for continuously removing microdust.

Said fibre opening device may be as described in any statement herein.

BRIEF DESCRIPTION OF THE DRAWINGS

Specific embodiments of the invention will now be described, by way of example, with reference to the accompanying diagrammatic drawings, in which.

DESCRIPTION OF THE PREFERRED EMBODIMENT AND BEST MODE

Figure 1:
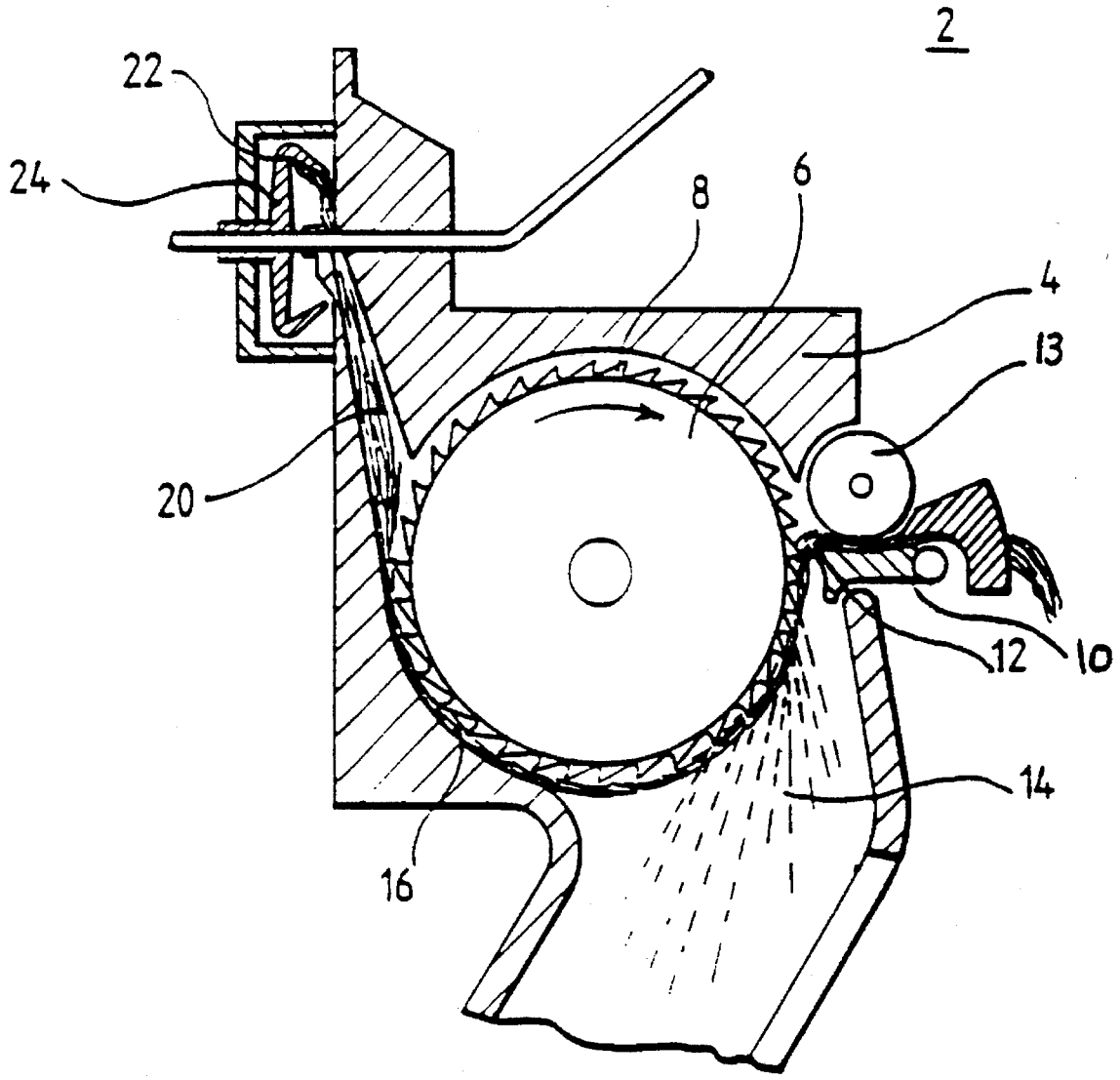
FIG. 1 is an end elevation in cross section, of a fibre opening device.

The fibre opening device 2, shown in FIG. 1, comprises a housing 4 in which a cylindrical fibre opening roller 6, is rotatably mounted. The roller 6 is provided with a helically wound card clothing wire 8 around its cylindrical surface. A feed table 10 and feed roller 13 are arranged to feed a fibre silver 12 to the opening roller 6. The fibre sliver 12 is propelled and separated into individual fibre strands by the rotating opening roller 6. The surface of the rotating opening roller 6 and fibre strands 16 carried thereon pass the mouth of a dirt chamber 14, into which dirt or other extraneous material from the fibre sliver may fall. Subsequently, the fibre strands 16 are released from engagement with the card clothing wire 8 and directed into a fibre entry duct 20 in which a vacuum prevails. From the fibre entry duct 20, the fibres are directed into a circumferential groove 22 of a spinning rotor arrangement 24.

Consistent separation of the fibre sliver 12 into individual fibres is only possible if the fibre sliver 12 contacts the card clothing wire 8, across the whole width thereof. Thus, the transfer of the fibre sliver 12 from the feed table and feed roller 13 to the fibre opening roller 6 is one critical step in the attainment of consistent separation of the fibre sliver and, in turn, the minimization of yarn defects. Steps in this transfer process are described below.

The fibre sliver 12 is propelled by the feed roller 13 and at the same time the card clothing wire 8 of the rotating opening roller 6 tries to take over the fibres. However, as long as the fibres are not released from being clamped between the feed roller 13 and table 10, only parallelisation of fibre strands takes place. It has been noted that, with an opening roller having eleven wire rows, only between six and eight of these wire rows become charged with fibres, this being due, at least in part, to the helical arrangement of the card clothing wire.

The helix of the card clothing wire 8 leads the fibre strands axially in the direction of the helix, and as long as the fibre strands are still held back by the feed roller 13 and the table 10, the strands move back as soon as they have been guided out to a distance greater than their staple length.

During that return movement, the fibres have to run through the linear pitch of the wire teeth and at this moment the fibres are individualised into single fibres, having no more contact with each other ("opened end"). At the same moment the fibres are released from being clamped between table 10 and feed roll 13, because the feed roll 13 is propelling the sliver.

It has been noted that, towards each outer edge 30 (FIG. 2*a*) of the cylindrical fibre opening roller 6, the fibre has a tendency to ride up away from the card clothing wire 8 and that, furthermore, in some cases, the sliver may ride up over radially outwardly facing surfaces 32 of the opening device 2. Both of these factors lead to inconsistent and incomplete separation of fibres and, consequently, to yarn defects. The embodiments of FIGS. 2*a* to 4 are adapted to encourage consistent and more complete separation of the fibres of the sliver 12. In particular, the embodiments are arranged to urge fibres into engagement with the card-clothed working surface of the opening roller before the fibres are released from being clamped between the feed roller 13 and feed table 10.

Figure 2A:
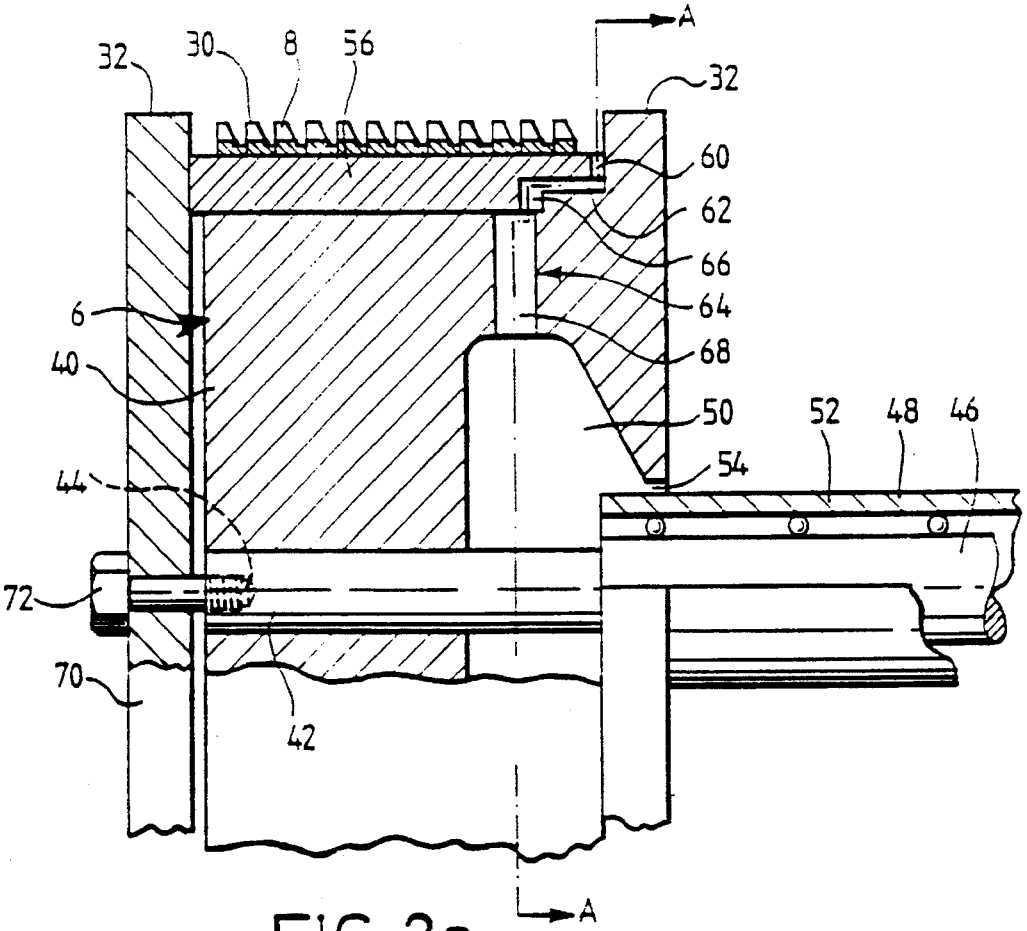
FIG. 2*a* is a cross-sectional view of part of a fibre opening device.

Referring to FIG. 2*a*, the fibre opening device 2 includes a generally cylindrical roller body 40 which is fixed to an axle 42. The axle 42 includes a threaded bore 44 at one end and, at its other end, is axially connected to an axle 46 which is rotatably mounted in a bearing housing 48.

The roller body 40 includes an annular chamber 50 which is axially aligned with and disposed around parts of the axles 42 and 46 and the bearing housing 48. The chamber 50 tapers inwardly towards an outer surface 52 of the bearing housing 48 so as to define a narrow annular passageway 54 which communicates with the chamber 50.

The roller body 40 is arranged to releasably secure an opening roller ring 56 around which the card clothing wire 8 is helically wound. Two slots 60, 61 are provided in the outer facing cylindrical surface of the ring 56. The slots extend inwardly from the outer periphery of the ring. The slots 60, 61 communicate with an axially extending annular part 62 of a passageway 64 which leads into the chamber 50. In more detail, the axially extending annular part 62 of the passageway communicates with a first radially extending annular part 66 which, in turn, communicates with a second radially extending bore part 68, the second part 68 being slightly axially offset relative to the first part 66. The parts 62 and 66 are defined by a stepped arrangement of the ring 56 and body 40.

A restraining flange 70 is fixed, by means of a screw 72 engaging the threaded bore 44, adjacent one end face of the roller body 40 and ring 56, to secure the ring 56 in position.

Figure 2B:
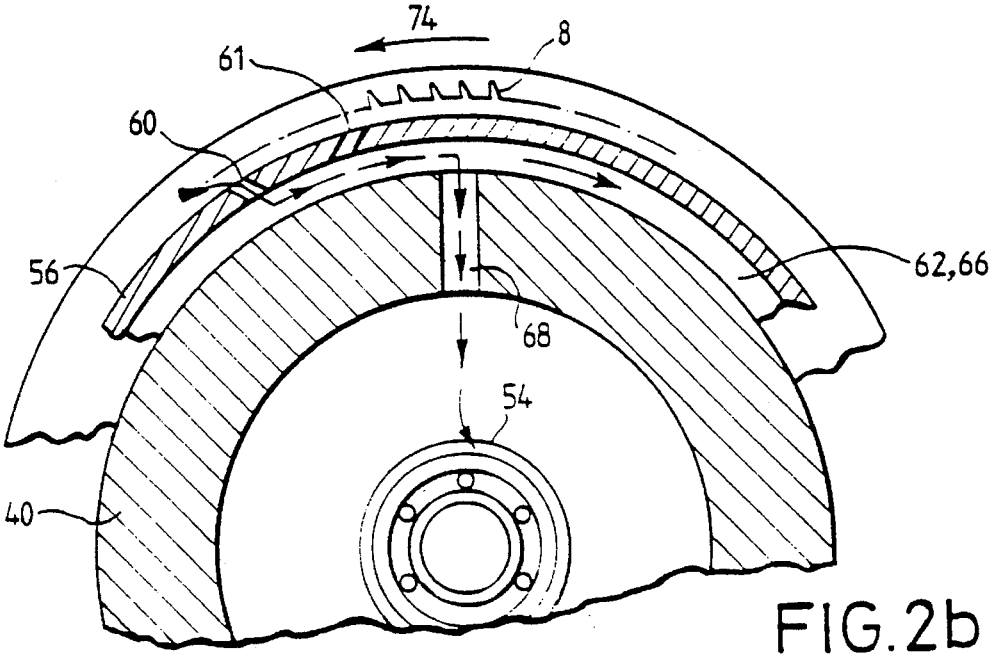
FIG. 2*b* is a cross-section along line A—A of FIG. 2*a;*

In operation, the roller body 40 is caused to rotate in the direction of arrow 74 (FIG. 2*b*). This rotation is believed to cause air to be drawn from a region outside the ring 56, through the slot 40 and passageway 64 and into the chamber 50. Air may leave the chamber 50 via the passageway 54. From the passageway 54, the air enters the dirt chamber 14. An air stream flows continuously as the roller 40 rotates and this is believed to lead to the relief of air pressure in an annular band above the slots 60, 61. Accordingly, whilst the fibre sliver is still held back under the control of the feed table and feed roller (FIG. 1), the fibre strands disposed above the annular band may be urged, due to the pressure relief and the air flow, into engagement with teeth of the card clothing wire 8, and, accordingly, the fibres of the sliver may be brought under control and separated as required by the card clothing wire 8.

It will be noted from FIG. 2*b*, that the slot 60 is angled in the same direction as that of the teeth of the card clothing wire 8—that is, at an acute angle to a tangent to the ring 56, measured in the direction of rotation 74; whereas the slot 61 is angled in an opposite direction to that of the teeth of the card clothing wire 8—that is, at an obtuse angle to a tangent to the ring 56 measured in the direction of rotation 74. It is believed that, with this arrangement, air is drawn into passageway 64 through slot 60 as discussed above, and a proportion of the air drawn in escapes through slot 61.

It has been noted that microdust is carried by the stream of air that passes through the slots 60 into the chamber and out of the passageway 54 and into the dirt chamber 14. Thus, the apparatus of FIG. 2 may affect positively both the separation of fibres of the fibre sliver and also the removal of microdust therefrom.

The FIG. 2 embodiment only includes slots 60, and associated passageways, adjacent to one outer edge of the opening roller 6. In this case, since the conveying direction of the helically wound carding wire 8 is towards the edge which includes the slots 60, 61, the slots may relieve pressure in the region where the accumulation of fibres is greatest.

Referring now to FIG. 3, the fibre opening device 80 is similar to the FIG. 2 embodiment and like parts in the Figures have the same reference numerals. The ring 82, however, shown in FIG. 3, includes four radially extending slots 84, 86, 88 and 90 which extend through the cylindrical surface of the ring. Slots 84, 86 are provided in one edge face on the roller 6 adjacent restraining flange 70 and are diametrically opposite one another; slots 88, 90 are provided in the other edge face of the roller 6 and are diametrically opposite one another.

Figure 3A:
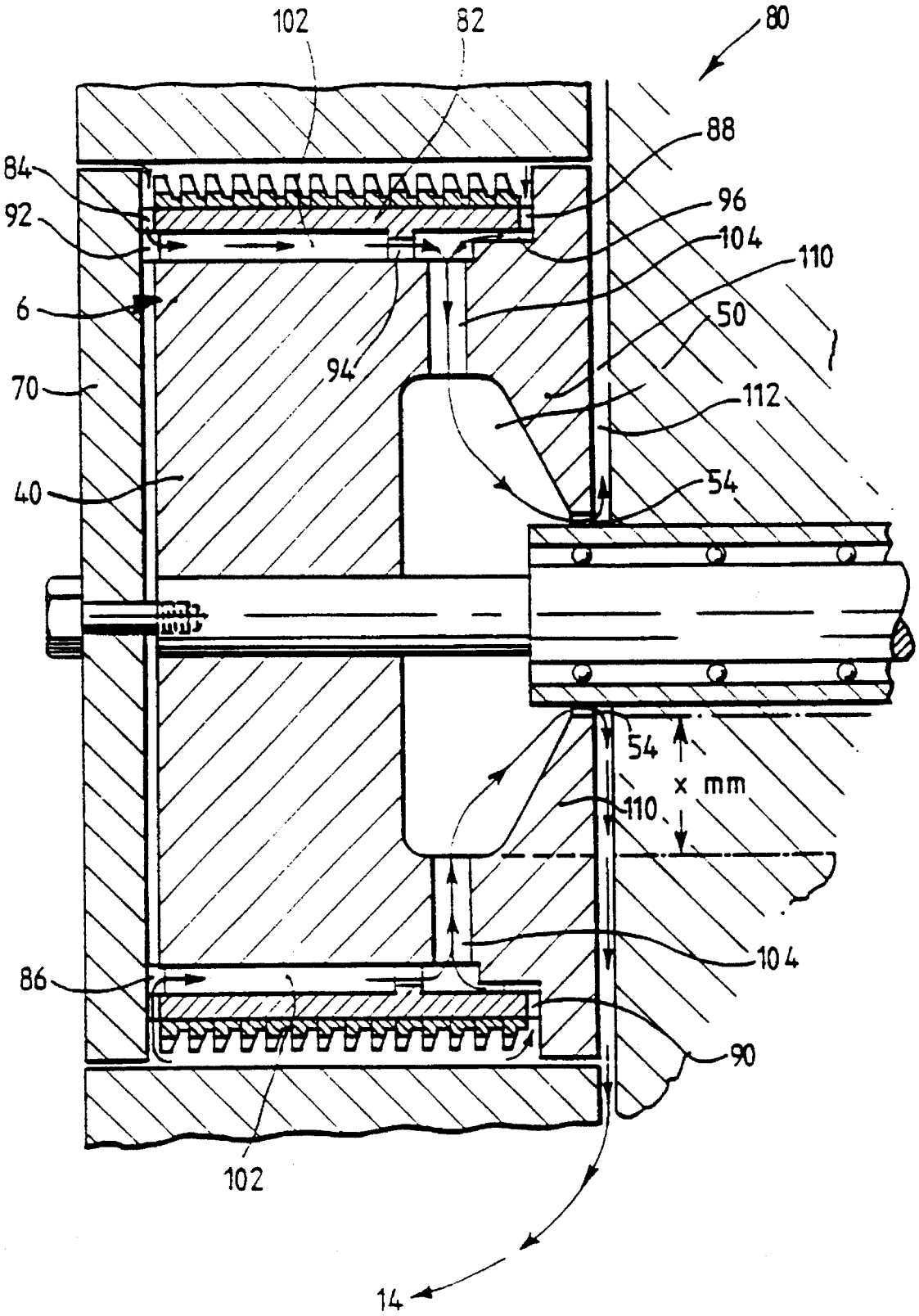
FIG. 3*a* is a cross-sectional view of part of another fibre opening device.
Figure 3B:
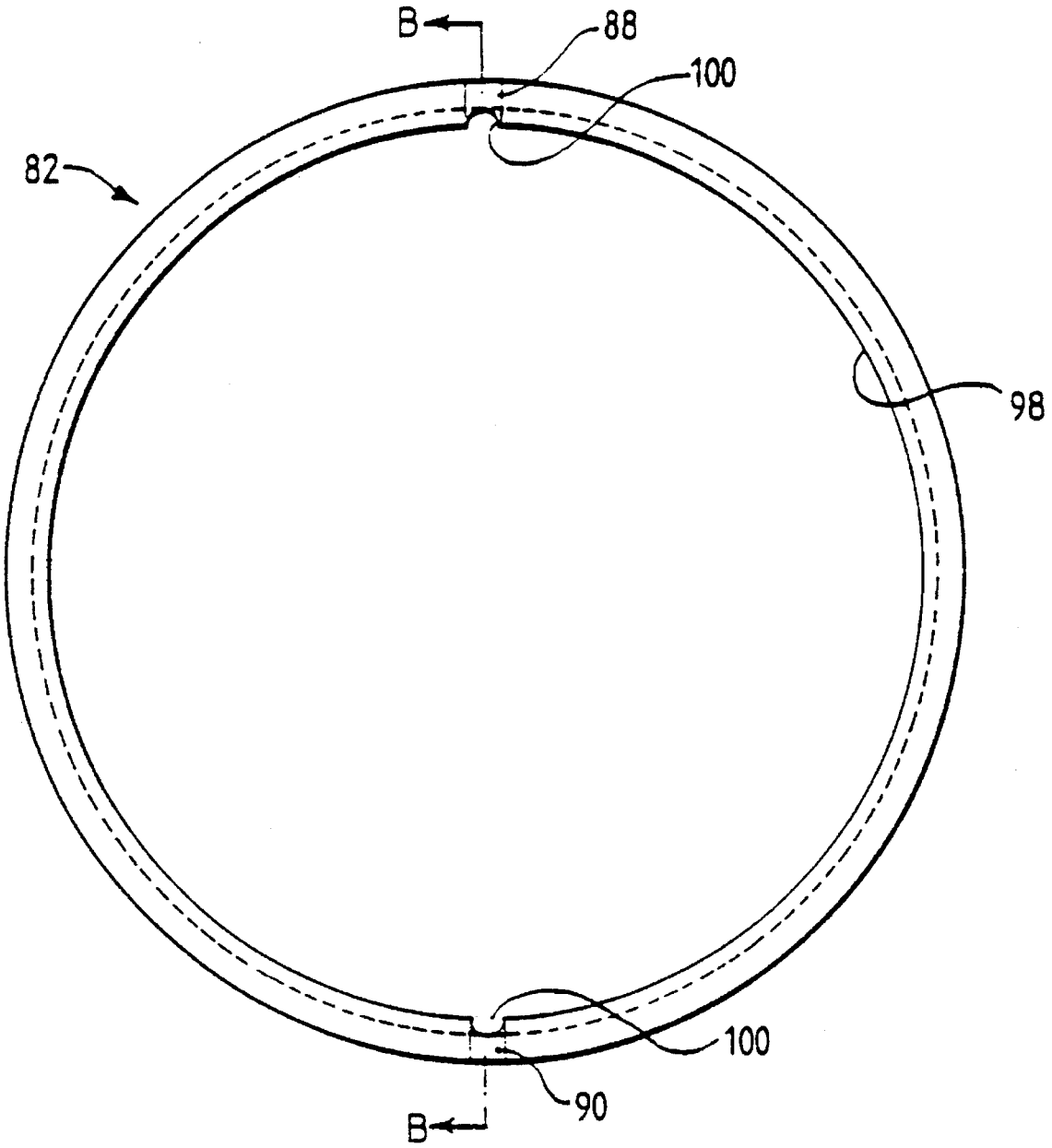
FIG. 3*b* is a side elevation of a ring for a fibre opening device.
Figure 3C:
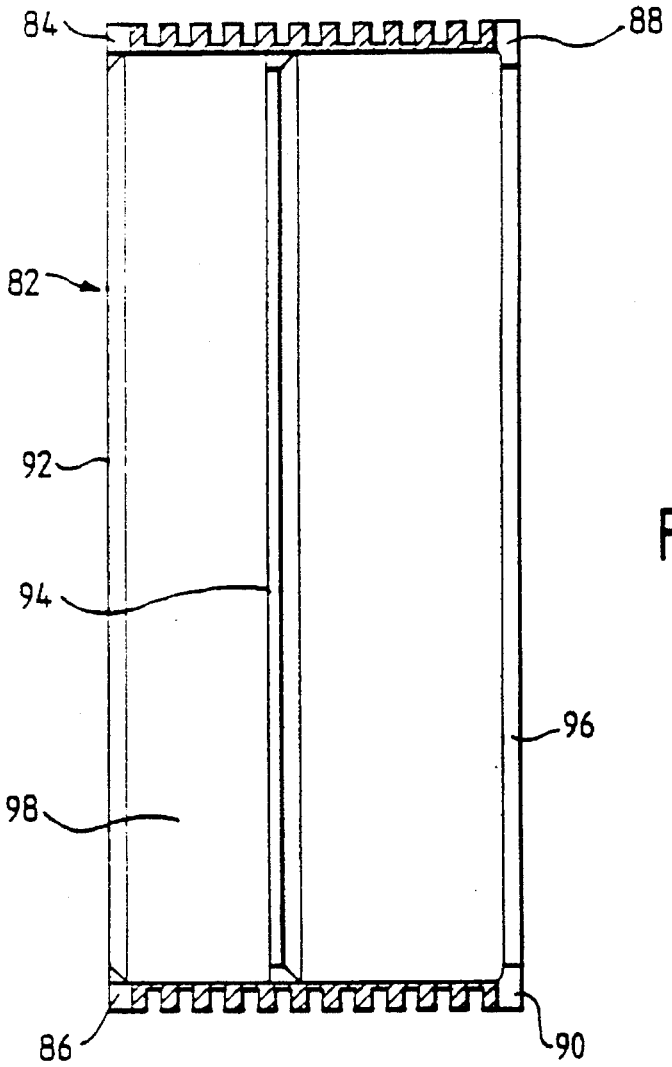
FIG. 3*c* is a cross-section along line B—B of the ring of FIG. 3*b;*
Figure 3D:
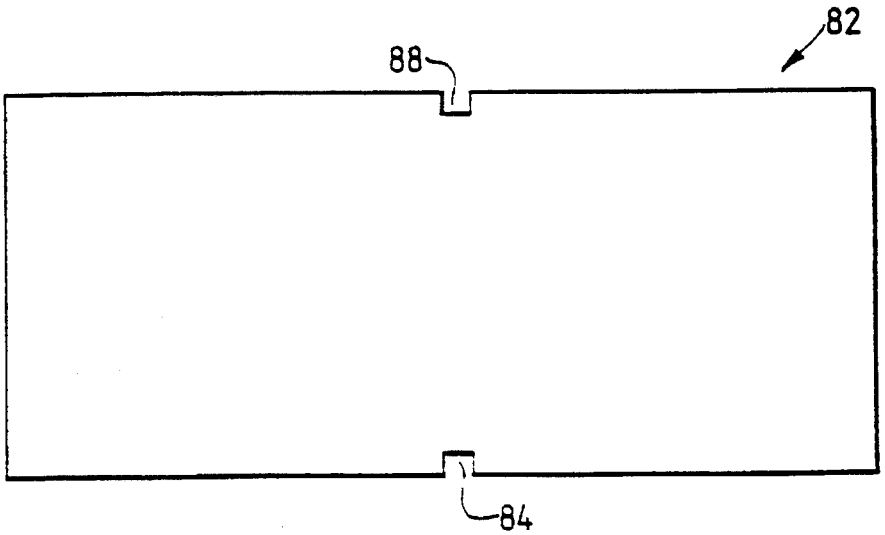
FIG. 3*d* is a plan view of the cylindrical surface of the ring, the card clothing wire or means for attachment thereof being omitted in the interests of clarity.

As shown in FIG. 3*b* and 3*c*, the ring 82 includes three axially spaced apart annular webs 92, 94, 96 which project from the inner cylindrical wall 98 of the ring 82 and, in the opening device 80, abut the roller body 40. Two diametrically spaced apart axially extending grooves 100 are cut into the webs 92, 94, 96 perpendicular thereto, so that, with the ring in position around the body 40, two diametrically spaced apart, axially extending passageways 102 extend between respective slots 84, 88 and slots 86, 90. The passageways 102 communicate with a respective radial bore 104 provided in the body 40. Each bore 104 leads into chamber 50.

Thus, when the opening roller 6 rotates, a stream of air may pass through slots 84, 86, 88, 90 along passageways 102 and radial bores 104 into the chamber 50. From the chamber, air passes via passageway 54, into the dirt chamber 14. The passage of the air stream is represented by arrows in FIG. 3*a*. Microdust may be carried in the air stream as described in relation to the FIG. 2 embodiment.

In order to increase the velocity of the air stream through the opening device 80, triangular cross-section part 110 of the body 40 may be removed so that the chamber 50 opens through the outer face 112 of the body 40. Thus an annular gap in the face 112 will be defined. The radial dimension of said gap being "x" mm, where x may be 0.5 mm or greater.

Fibre opening devices which are presently available may readily be modified so that they may benefit from the advantageous effects described herein. For example, a ring 82, shown in FIG. 3, may be used in conjunction with the carding roller unit described in U.K. Patent 2 114 172 (Stahlecker), so that an air stream may be caused to flow through the roller body thereof.

Figure 4:
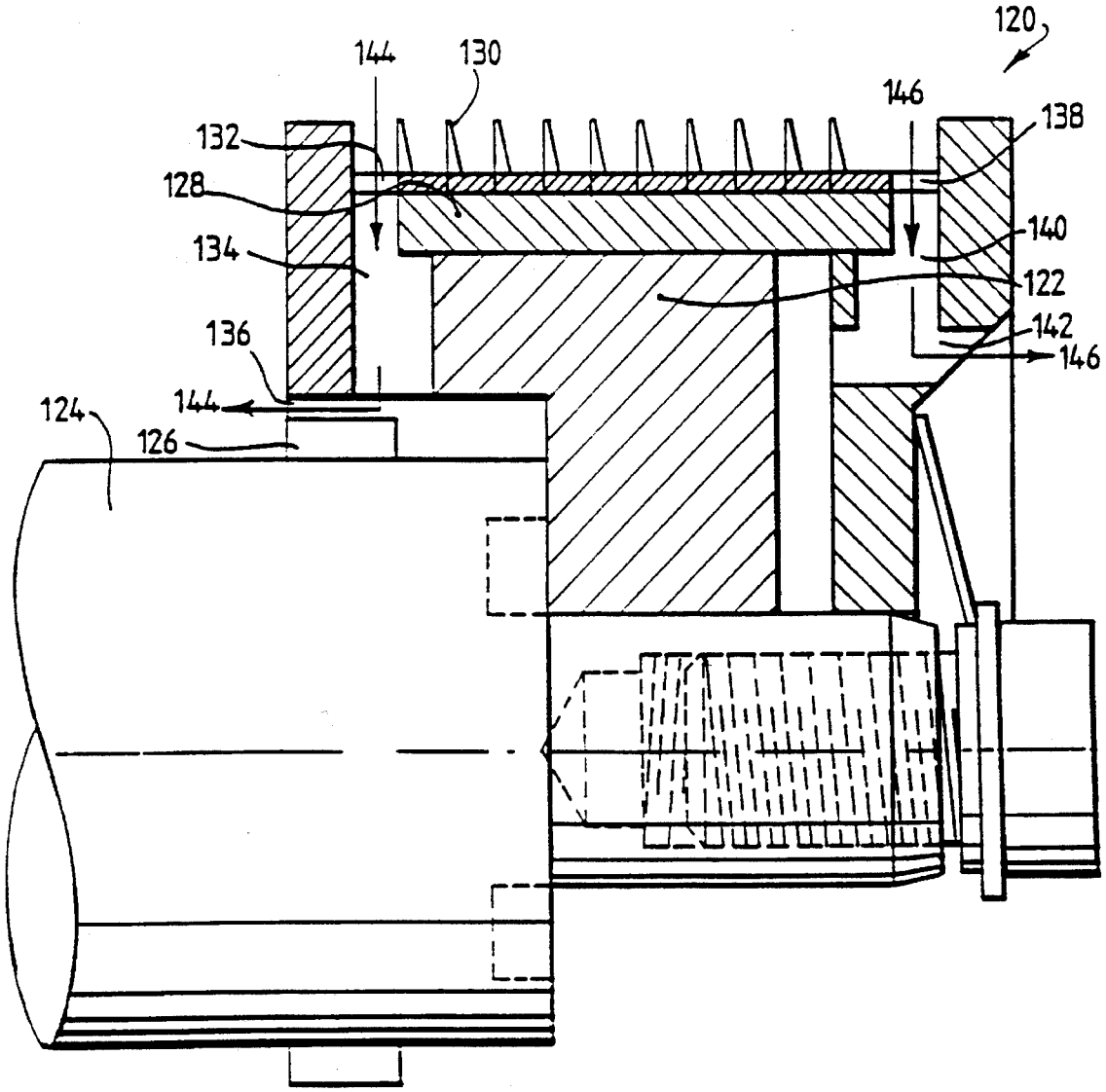
FIG. 4 is a cross-sectional view of part of another fibre opening device.

An alternative fibre opening device may be provided, as shown in FIG. 4.

The fibre opening device 120, shown in FIG. 4, includes a body 122 fixed to a hub arrangement 124 which is supported in bearings 126. A ring 128 to which card clothing wire 130 is fixed is fitted around the body 122. A radially extending slot 132 extends through the ring 130 adjacent one outer edge thereof, the slot 132 communicating with a radially extending passageway 134 provided in the body 122. An axially extending passageway 136 communicates with the passageway 134 and leads away from the roller body 122. Similarly, a radially extending slot 138 extends through the ring 130 adjacent the other outer edge thereof, the slot 138 communicating with a radially extending passageway 140 which, in turn, communicates with an axially extending passageway 142 which leads away from the body 122.

When the body 122 rotates air streams flow through the body as shown by arrows 144 and 146.

In each of the aforementioned embodiments, a slot or slots is/are suitably provided in a part of the cylindrical surface of the opening roller between an outermost part of the carding wire and the periphery of the cylindrical surface. In use, whilst a fibre sliver is still held back under the control of a feed table and feed roller arrangement, air flow through the slot(s) tends to result in the axially outermost fibres of the sliver being brought under control so as to be urged into engagement with the carding wire, thereby increasing the effectiveness of fibre separation by the opening roller. Additionally, a plurality of holes may be provided between the windings of the carding wire for removing microdust.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompany claims, abstract and drawings), may be replaced by alternative features serving the same, equivalent or similar purpose, unless expressly stated otherwise. Thus, unless expressly stated, otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. A fiber opening device for use in a discontinuous spinning process, the opening device comprising an opening roller rotatably mounted about an axis and having a cylindrical working surface which extends around said axis, opening elements being provided around said working surface and a space being defined between an axially outermost fiber opening element and an adjacent outer edge of the cylindrical working surface, wherein pressure reduction means is provided for reducing pressure in or around that space, said pressure reduction means being arranged to urge fibers into engagement with the working surface.

2. A fibre opening device according to claim 1, wherein said pressure reduction means includes a passageway, a first end of which has an opening provided in or adjacent to said space.

3. A fiber opening device according to claim 2, wherein said opening is provided in said space in the cylindrical working surface.

4. A fibre opening device according to claim 3, wherein a second end of the passageway opens through a side of the opening roller.

5. A fibre opening device according to claim 2, wherein an annular chamber is provided in said passageway, the chamber being coaxial with the rotational axis of the opening roller.

6. A fiber opening device according to claim 5, wherein an annular opening which leads into the annular chamber is defined in a side wall of the opening roller, said annular opening being coaxial with said axis of the opening roller.

7. A fiber opening device according to claim 6, wherein an inner annular wall of said annular opening in said side wall is defined by a structure group consisting of a part of the nub and bearing housing.

8. A fibre opening device according to claim 6, wherein the radial width of said annular opening is greater than 0.1 mm.

9. A fibre opening device according to claim 2, wherein a plurality of openings and associated passageways are provided, said openings being circumferentially spaced around the working surface of the opening roller at or adjacent to the outer periphery thereof.

10. A fiber opening device according to claim 1, wherein said opening roller of said device has an end face which extends perpendicularly to said axis of said opening roller, and wherein an opening is provided adjacent to the opening roller in a part having a surface which faces said end face, said opening leading into a passageway in order to provide said pressure reduction means.

11. A fibre opening device according to claim 1, wherein a pressure reduction means is provided adjacent to each outer edge of the cylindrical working surface.

12. A fibre opening device according to claim 1, wherein said cylindrical working surface of the opening roller is comprised by a ring which is releasably securable to a body of the opening device, an inside surface of said ring defining, at least in part, the outer cylindrical boundary of a passageway which extends parallel to the axis of rotation of the opening roller.

13. A ring for a fiber opening device according to claim 1, the ring having an axis and a cylindrical working surface which extends around said axis and which includes means for attachment of fiber opening elements, a space being defined between an axially outermost portion of said means for attachment and an adjacent outer edge of the ring which is axially spaced from said axially outermost portion, wherein an opening is provided in said space which opening extends though said ring.

14. A ring for a fiber opening device according to claim 1, the ring having an axis and a cylindrical working surface which extends around said axis and which includes attached fiber opening elements, a space being defined between an axially outermost fiber opening element and an adjacent outer edge of the ring which is axially spaced from said attached fiber opening element, wherein an opening is provided in said space which opening extends through said ring.

* * * * *